United States Patent [19]

Raydon et al.

[11] 3,969,588

[45] July 13, 1976

[54] AUDIO PAN GENERATOR

[75] Inventors: Stephen M. Raydon, Boulder; Ronald E. Hays, Northglenn, both of Colo.

[73] Assignee: Video and Audio Artistry Corporation, Boulder, Colo.

[22] Filed: Nov. 29, 1974

[21] Appl. No.: 528,220

[52] U.S. Cl. ..... 179/1 G; 179/1 GQ

[51] Int. Cl.[2] ..... H04R 5/00

[58] Field of Search ..... 179/1 GP, 1 GQ, 1 G, 179/100.1 TD; 84/DIG. 1

[56] References Cited

UNITED STATES PATENTS

| | | | |
|---|---|---|---|
| 2,792,449 | 5/1957 | Bottini | 179/100.1 TD |
| 3,018,335 | 1/1962 | De Rosa | 179/1 G |
| 3,586,783 | 6/1971 | Brickner | 179/1 GQ |
| 3,725,586 | 4/1973 | Iida | 179/1 G |
| 3,757,046 | 9/1973 | Williams | 179/1 GQ |
| 3,873,779 | 3/1975 | Wedan | 179/1 GQ |

OTHER PUBLICATIONS

Journal of the Audio Engineering, The Strobophone, L. A. Geddes et al., Mar., 1972, vol. 20, No. 2, pp. 115–117.

*Primary Examiner*—Kathleen H. Claffy
*Assistant Examiner*—George G. Stellar
*Attorney, Agent, or Firm*—Reilly and Hancock

[57] ABSTRACT

The apparent source of sound from a plurality of transducers arrayed around a listening area is automatically controlled by a prestored pattern sequencer and a series of variable voltage levels. The prestored patterns reflect switch connections to the transducers which are energized by varying signals so that the sound appears to the listener to move relative to the transducers. In one embodiment, varying analog signal levels are switched under pattern control while, in another embodiment, the controls are entirely effected with digital circuitry up to the final analog output stages. The sequences of switch patterns can be automatically selected or operator selected and can provide the effect of rotating sound or any of a wide variety of prestored patterns.

28 Claims, 14 Drawing Figures

| | | A | B | C | D |
|---|---|---|---|---|---|
| (a) | QO | 0 | 1 | 0 | 1 |
| | Q1 | 0 | 0 | 1 | 1 |

AUDIO PAN GENERATOR

BACKGROUND OF THE INVENTION

This invention relates to a system for panning apparent audio sound relative to a listening area through automatic controls. More particularly, the present invention relates to control systems for audio reproduction wherein the apparent source of one or more sounds can be panned relative to the listening area.

Various prior efforts have been directed toward producing apparent sound sources which move relative to a plurality of speakers as perceived by a listener. The classic two-channel stereo systems provide this effect by recording from multiple receiving devices into the two channels which then produce sound movement effects through the reproduction of those two channels at a plurality of transducers. Such systems are effectively restricted to sound reproduction of the actual recordings and generally utilized only for apparent sound movement relative to two output speakers.

More recently, efforts have been directed towards obtaining sound which appears to come from any direction relative to a listener in so-called quadraphonic effects by situating three or more speakers around the listening area. One of these means for controlling the quadraphonic reproduction is through a four-way joystick control by the operator. Yet another is to cyclically connect the audio sources to the various speakers so that the sound appears to continuously rotate around the listening area, one such system being shown in U.S. Pat. No. 3,374,315 by Gladwin. Yet another system which causes sound rotation between speakers is shown in U.S. Pat. No. 3,568,783 by Brickner wherein a low frequency audio spectrum is subsonically rotated between low frequency speakers to enhance the stereo effect of the system. An arrangement intended to improve the distance and reverberation effects for sound movement is shown in U.S. Pat. No. 3,665,105 by Chowning.

Although the prior art systems have improved the stereophonic quality of sound reproduction and have further enhanced the quadraphonic effects, the prior art does not permit the operator to readily select from prestored quadraphonic effects nor does it provide an arrangement wherein multiple sound sources can appear to follow preselected apparent sound patterns under operator or automatic controls.

SUMMARY OF THE INVENTION

The present invention is apparatus and methods for producing apparent sound sources in accordance with prestored patterns by extensive use of digital circuitry. More particularly, the present invention contemplates the generation of control signals which specify shifting levels for output transducers and which further include a memory arrangement for prestoring switching patterns. The prestored patterns can be selected automatically or by operator control so that the apparent sound will be transferred from one or more sources through the transducers arrrayed around a listening area in accordance with the prestored pattern. It is generally contemplated that this invention will accept audio signals from an external source and selectably couple those signals into appropriate arranged output speakers. The source can be one or more single or multitrack recordings, single or multiple microphones or combinations of these. The invention is also well suited for controlled quadraphonic recording ot its output.

In one embodiment, the signals for shifting the apparent sound as between the transducers are produced as varying analog levels and switched to the output transducers as a function of prestored switching patterns from a memory device. This memory is addressed by the operator or by automatic means and, as each panning effect of the analog signal completes a cycle, shifts the output transducers that are being coupled so as to provide the illusion of sound movement.

In yet another embodiment to be described later, the various potential shifting levels as between transducers is digitally produced including increasing, decreasing, or fixed levels with this digital sequence being switched into an analog switching network in accordance with the prestored pattern selected. The prestored pattern determines which audio transducers will be selected and the digital position control generates cyclic digital sequences that are converted to analog levels and mixed prior to introduction to the guadraphonic transducers.

In either embodiment, the audio source can be any of those which are already available including multiple channel sources. Further, both embodiments permit holding of the apparent sound source at any position desired so that the apparent sound motion can be stopped or caused to return to its originating position as desired. Still further, both embodiments permit selection of the frequency of cycling of the apparent sound movement between transducers.

Accordingly, a primary objective of this invention is to provide manual or automatic control of apparent sound movement relative to two or more audio output transducers.

Yet another object of this invention is to apply extensive digital techniques to the control of sound sources which can appear to move through any pattern relative to the listener or in directions towards and away from the listener.

A still further object of this invention is to provide control of various apparent sound sources within a listening area with minimal disturbance to the listener but with maximum potential control for the listener.

Another object is to provide controlled switching of signals from one or more sources into two or more output devices in accordance with prestored patterns.

A further object is to provide a method and means for panning audio from one or more sources between two or more transducers in accordance with preselected patterns.

The foregoing and other possible objects, features and modifications will be readily apparent in view of the following description of the preferred embodiments.

DESCRIPTION OF THE PREFERRED EMBODIMENTS

Figure 1:
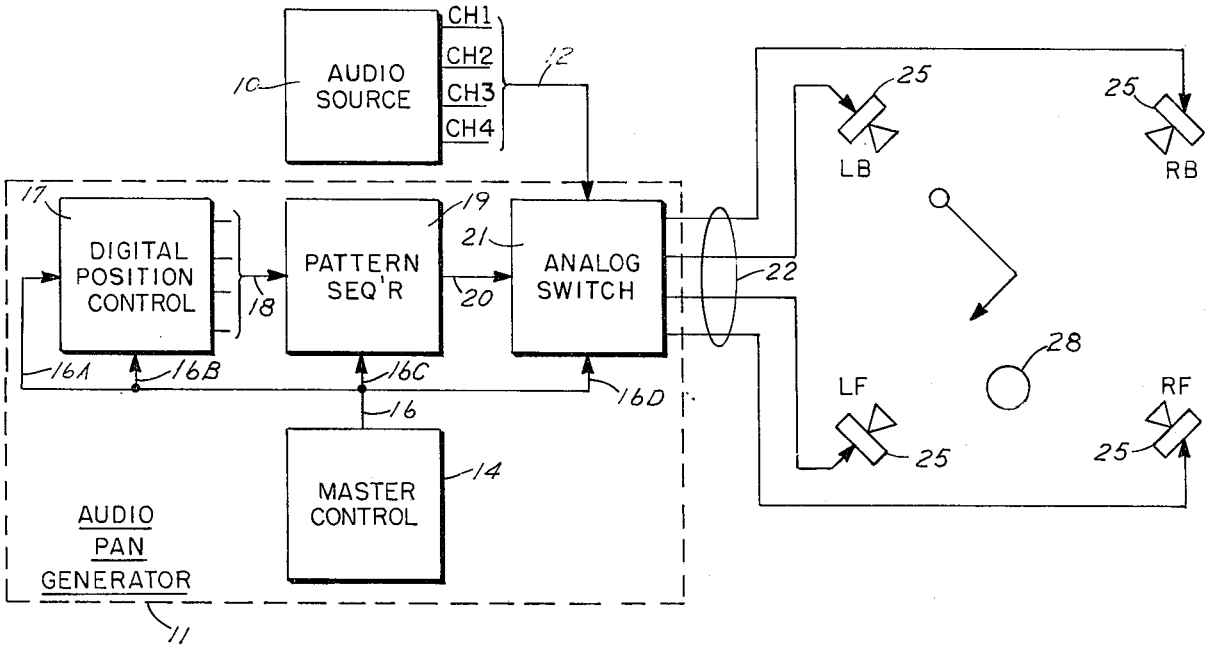
FIG. 1 is a general system block diagram showing the interconnection of one or more audio sources into a plurality of output transducers by means of an audio pan generator in accordance with this invention.

Referring to the drawings and particularly to FIG. 1, there is represented an audio source 10 which may be, although not limited to, a conventional four-channel tape recorder, record player, microphonic system, or tuner with a corresponding conventional amplifying system. Four conventional loudspeakers 25 are energized by signals on audio output leads 22, the combination being designated: left front LF, right front RF, right back RB, and left back LB. In accordance with the present invention, the audio pan generator 11 as shown in FIG. 1 couples the audio inputs 12 from the audio source 10 to the loudspeakers 25 to create a host of unusual sound effects for the listener 28. One effect, as shown in FIG. 1, is the sensation of sound, such as a moving train, heading directly towards the listener 28 and suddenly veering off as graphically illustrated by the apparent sound source and direction 26. The audio pan generator 11 determines the pattern the apparent sound source 26 follows, the speed and direction the apparent source 26 travels, and numerous other features hereinafter elaborated on.

The audio pan generator 11 contains four functional components: the digital position control 17, the pattern sequencer 19, the analog switch 21 and the control 14. A general discussion of the audio pan generator 11 follows presenting a brief overview of its major features. The control 14 will be described in terms of apparatus to allow an operator to manually control the audio pan generator 11 on leads 16. The control 14 provides speed and direction controls on branches 16*a* and 16*b*, respectively, pattern selection controls on branch 16*c*, channel selection and volume controls on branch 16*d*, and various other feature controls.

The digital position control 17 responsive to operator commands on branches 16*a* and 16*b* provides the timing for the audio pan generator 11 and determines the speed and initial selection of the direction the apparent sound source 26 travels. The pattern sequencer 19 has a memory containing sufficient digital information to reconstruct any pattern selected on branch 16*c* from control 14 in order to effectuate the actual pattern of sound followed by apparent sound source 26. The pattern sequencer 19 also incorporates the speed and direction values on lead 18 from the digital position control 17 with the pattern memory data and outputs this combined pattern and feature information onto leads 20. The analog switch 21 transfers and allocates the audio input signals on leads 12 which are selected by appropriate commands on branch 16*d* to the audio output leads 22 according to the pattern and feature information from the pattern sequencer 19.

In actual operation, the operator generally initializes the control 14 for direction, speed, type of pattern and channels to be used. The digital position control 17 responds to the speed and direction commands, the pattern sequencer 19 responds to the pattern select command and the analog switch 21 responds to the channels selected. The timing, direction and speed information from the digital position 17 is combined with the pattern information from the pattern sequencer 19 to cause the analog switch 21 to couple the audio inputs 12 of the selected channel to the audio outputs 22 in a predetermined manner to create the pattern of sound from the listener 28.

Figure 2:
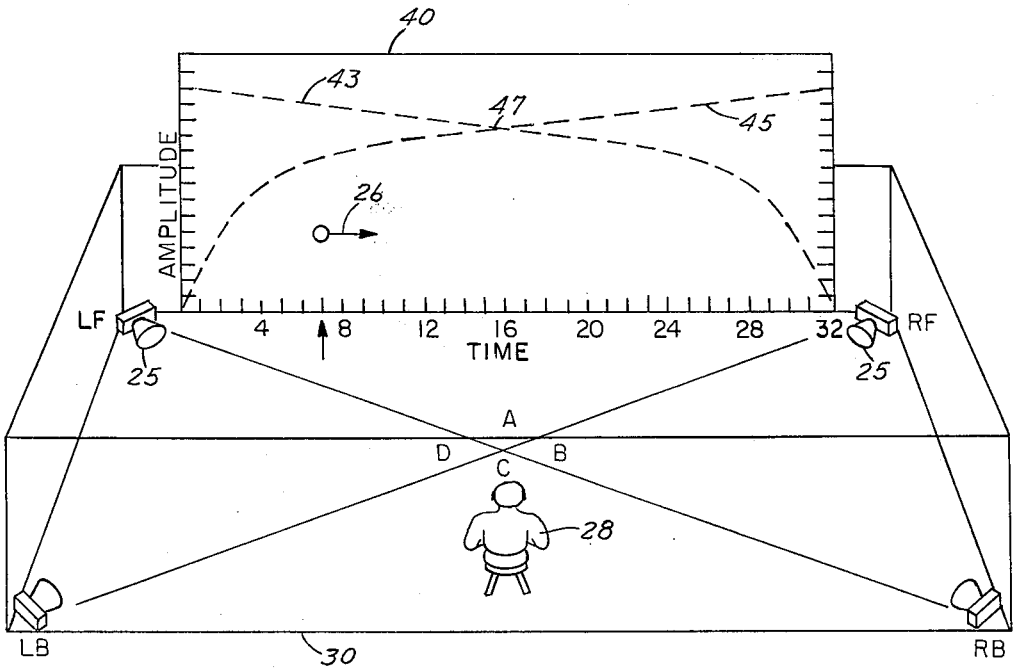
FIG. 2 illustrates the amplitude control as a function of time for effecting the pan between at least two output transducers.

Those skilled in the art are familar with the "panning effect" as depicted in FIG. 2. As an example, assume that the sound in channel CH1 initially originates from loudspeaker LF, then to listener 28 situated in a room 30, the apparent sound source 26 which is the sound from the channel CH1 "pans" or moves from loudspeaker LF to loudspeaker RF, when the amplitude of sound in loudspeaker LF decreases with time, graphically portrayed on chart 40 as amplitude curve 43; and, simultaneously, the amplitude of sound in loudspeaker RF increases with time, as graphically portrayed in amplitude curve 45. At time T, for example, the amplitude D (for "decreasing") is the level of sound from channel CH1 emanating from loudspeaker LF and the amplitude I (for "increasing") is the level of sound from channel CH1 emanating from loudspeaker RF. Of course, when the sound of channel CH1 has moved to loudspeaker RF, D is at zero amplitude and I is at maximum amplitude.

In order to create the sound effect of FIG. 2, the functional relationship of the audio pan generator 11 of FIG. 1 allocates tasks as follows: The control 14 selects both the sound from channel CH1 from audio source 10 and the pattern for the sound to follow for panning between speakers LF and RF, and control 14 also selects the speed and direction i.e., forward or reverse, of the pan. The digital position control 17 receives these commands from the operator control 14 and transmits timing and direction information to the pattern sequencer 19 which combines this information with the pattern information, i.e. pan from LF to RF. The analog switch 21 responds to the combined feature and pattern information, i.e., pan in a forward direction from LF to RF at a certain speed; couples the sound from the selected channel CH1 to both speakers LF and RF according to the panning effect shown in chart 40 of FIG. 2. As will be discussed later, various other features in the control 14 include: home, hold, cross mode and chase mode commands. The "home" position is selected by pattern off and reset and results in direct couling of channels from the audio source 10 to respective speakers 25 as prewired by the user. In this example, the channel to speaker correlation is as follows: CH1 to LF, CH2 to RF, CH3 to LB and CH4 to RB. Assuming the pan pattern configuration of FIG. 2 wherein the sound 26 from channel CH1 appears at time T to pan from LF to RF, selection of the "home" command causes the sound 26 to instantly return to speaker LF since channel CH1 norrmaly originates from speaker LF while the "hold" command freezes the sound 26 at the T position and prevents further panning. Assume further that sound from channel CH2 originates in "home" speaker RF. In the "cross-mode" command the channel CH1 sound 26, in FIG. 2 pans from LF to RF while at the same time the sound from channel CH2, not shown in FIG. 2, cross-pans from RF to LF creating the unusual effect of sound passing each other in opposing directions. In the "chase mode" the sound 26 from channel CH1 pans, as shown in FIG. 2, from LF to RF while the sound, not shown, from channel CH2 pans from RF to RB creating the unusual effect of the sound in channel CH1 "chasing" the sound in channel CH2. The mode of operation for these effects and others will become clear in the following disclosure of two alternate preferred embodiments.

Figure 3:
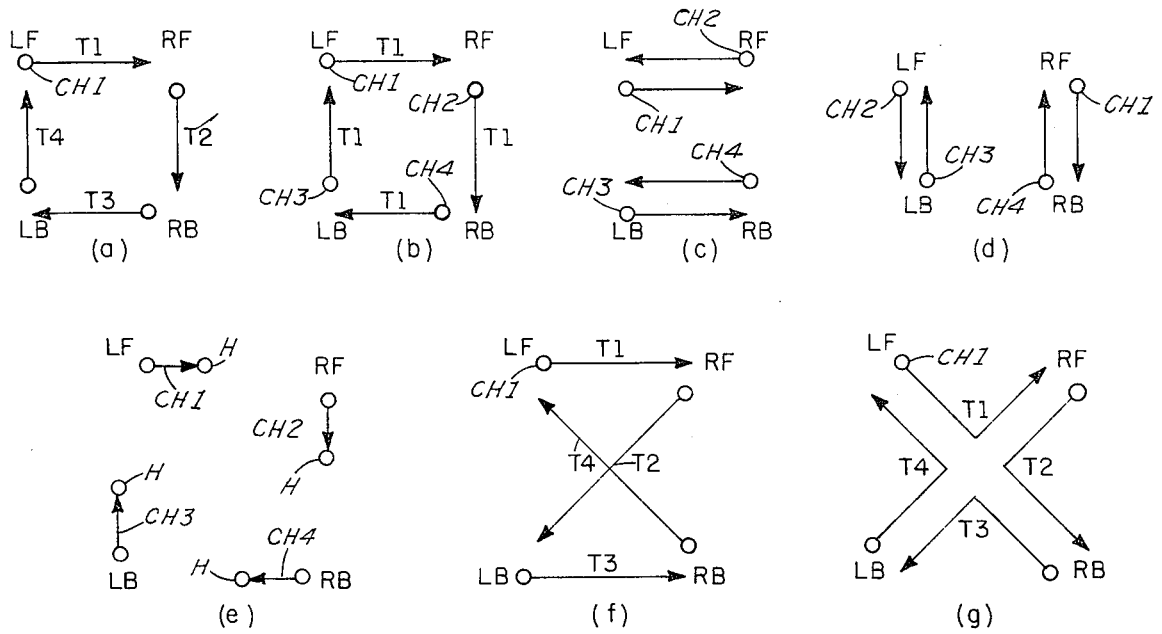
FIG. 3 illustrates various potential panning sequences which can be produced through the use of the present invention.

Two embodiments will be discussed, the first alternate embodiment, during a given time interval, utilizes the panning effect between any two loudspeakers 25 as shown in FIG. 2. In FIG. 3, some of the two-speaker pan effects, though not all, created by the first embodiment are shown to be the movement of the apparent sound source from channel CH1 among the various loudspeakers LF, RF, RB and LB. In the rotary pan effect, shown in FIG. 3*a*, the apparent sound source from channel CH1 moves in a circular fashion around listener 28. In time interval T1, the sound pans from LF to RF; in time interval T2, the sound pans from RF to RB and so forth, until time interval T4 when the sound pans from LB to home position LF. The speed of the apparent sound source from channel CH1 around the room 30 is selected by operator control 14 on pan speed input lead 16*a* hereinafter discussed. The direction of the apparent sound source CH1 is also selected by control 14 on pan features input lead 16*b*.

The above discussion centered on one apparent sound source, for example, from channel CH1 of audio source 10. In actual operation with four channels wherein channel CH1 originates from home speaker LF, channel CH2 originates from home speaker RF, channel CH3 originates from home speaker LB and channel CH4 originates from home speaker RB, other sound effects shown in FIGS. 3(*b*)–(*c*) can be created. FIG. 3(*b*) shows the rotary pan in a chase mode wherein the sound in each speaker chases the sound in the next speaker around the room. In FIG. 3(*b*) which shows only time interval T1, channel CH1 pans to RF, channel CH2 pans to RB, channel CH3 pans to LF amd channel CH4 pans to LB. FIG. 3(*c*) shows the rotary pan in a cross mode wherein the sound from the speakers to the left and right of the listener appears to cross. For example, FIG. 3(*c*) and 3(*d*) repsectively illustrate the first two time intervals T1 and T2. During the time interval T1, channel CH1 pans to RF while channel CH2 pans to LF and channel CH3 pans to RB while channel CH4 pans to LB. This creates the sound effect, for purposes of illustration, of two trains passing each other in opposite directions.

FIG. 3(*e*) illustrates an additional feature of instantly stopping the pattern movement and freezing the apparent sound sources into a static or hold position H. This feature is available on pan features input lead 16*b*. Thus the operator, who is generally the listener, may cause the rotary pan to speed up, to slow down, to stop, to change direction, or to control the number of circular passes. Such features apply to the remaining illustrated two-pan patterns in FIGS. 3(*f*) and 3(*g*) as well as any other imaginative two-pan pattern programmed into pattern sequencer 19.

The present invention is by no means limited to the first embodiment of four channels and two-pan effects. As will be discussed hereinafter, obvious changes by those skilled in the art to the present invention could create among others the unusual effects shown in FIG. 4.

Figure 5:
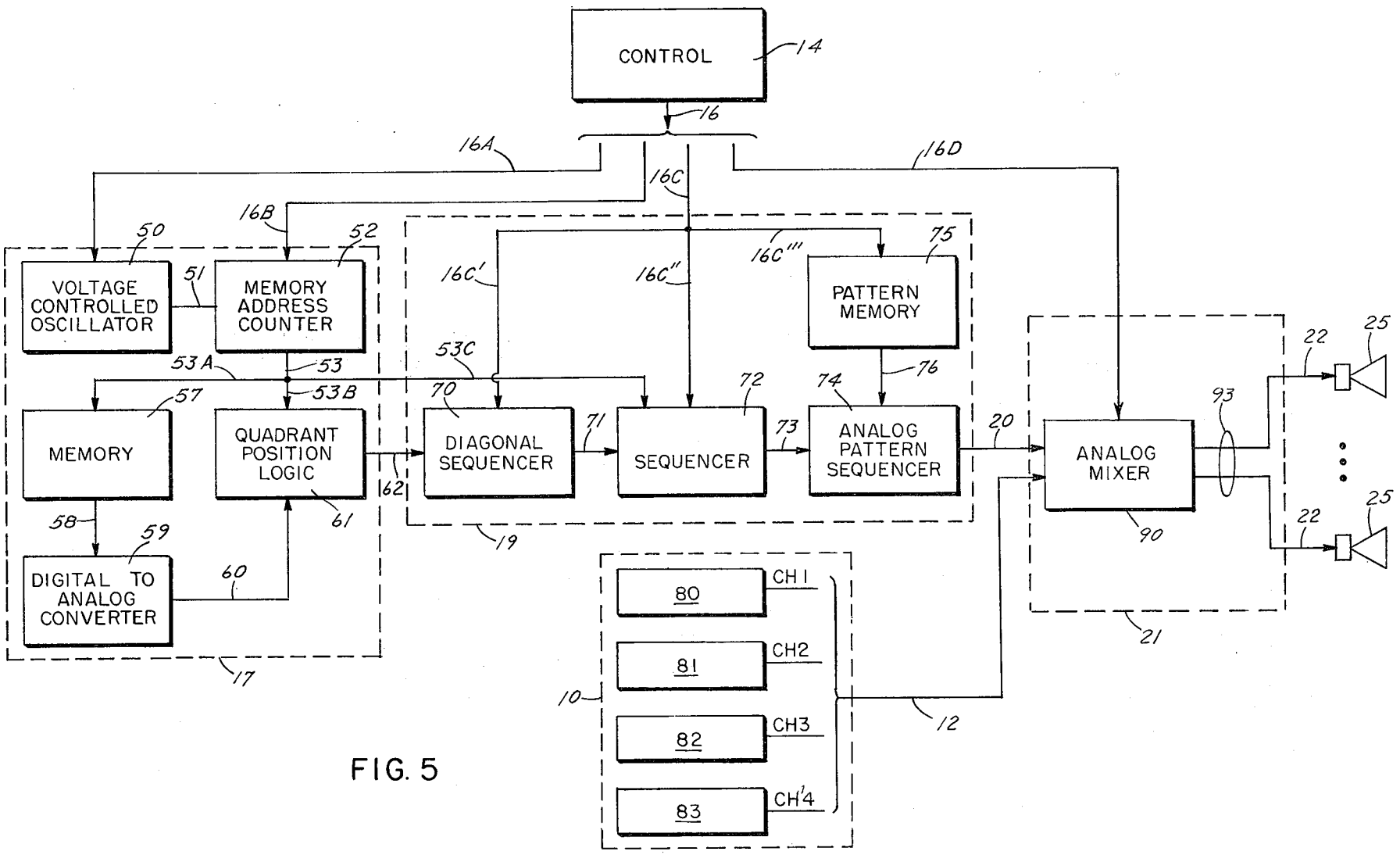
FIG. 5 is a block diagram of a first embodiment of this invention.

The first embodiment of the audio pan generator 11 detailed in FIG. 5 comprises the control 14, the digital position control 17, the pattern sequencer 19, and the analog switch 21.

Control 14 as used in this illustration provides a manual control for the audio pan generator 11 and enables the operator to manually select various sound effects for the apparent sound source 26. It will be readily understood by those having normal skill in the art that controls 14 can easily be adapted to remote operation or to control from other sources such as a computer or the like. The operator control 14 interfaces the digital position control 17, the pattern sequencer 19, and the analog switch 21 in the following manner: Output lead 16a delivers a variable voltage, which can be formed by a potentiometer or any conventional variable voltage source, to the digital position control 17. By varying the voltage on lead 16a, the apparent sound source 26 can be made to speed up or slow down. Output leads 16*b* deliver binary values of "zero" and "one" to the digital position control 17 which if appropriately selected "resets", "sets", and "holds" the contents of the binary counter 52 in a conventional manner in order to cause the apparent source 26 to return to a " home" condition, such as by clearing counter 52, or to a "hold" condition, such as by blocking further VCO 50 pulses from counter 52. Output leads 16c access the pattern sequencer 19 with a plurality of binary commands. These binary commands are generated in a conventional manner by panel switches and selectors on the operator control 14. The commands on output leads 16c select the pattern and the various effects such as the cross and chase modes. Output leads 16d access analog switch 21 with a plurality of variable voltage signals designed to provide an over-riding manual control of the volume and mixing of audio signals before delivery to speakers 25.

The digital position control 17 comprises: a voltage controlled oscillator 50 for generation of timing pulses, a memory address counter 52 in conjunction with a read only memory 57 and a digital-to-analog converter 59 for generation of data necessary to effectuate the panning effect shown in FIG. 2, and quadrant position logic 61 for selection of a quadrant, A, B, C, or D in which to pan the sound as also found in FIG. 2.

The pan speed input signal generated on lead 16a from operator control 14 applies a variable voltage into a conventional voltage controlled oscillator such as the model CMOS 4046 made by RCA or Motorola Corporation. The output on lead 51 is a stream of digital timing pulses corresponding, in frequency to the voltage signal level on lead 16a. The timing pulses on lead 51 access a conventional memory address counter 52 such as CMOS 14516/4080. The purpose of the memory address counter 52 is to generate a binary address for addressing data in the read only memory 57 via 53*a*.

The timing pulses on lead 51 increment or decrement the counter 52, depending on the binary "direction" command on one of the pan feature inputs 16b from operator control 14. As will be later discussed, whether the counter is being incremented or decremented determines whether the apparent sound source 26 moves in the forward or reverse directions to listener 28. In circle pan, forward = clockwise and reverse = counter-clockwise.

Another binary command from operator control 14 on one of the pan feature inputs **16*b* causes the memory address counter 52 to ignore the timing pulses 51 and to "hold" or freeze the address counter by disabling counter 52 in a conventional fashion. Such action by the operator control 14 stops the panning effect and the apparent sound source 26 stops moving and becomes stationary to listener 28 as shown in FIG. 3(e). This unique feature, "hold", places the sound anywhere within the room 30 at the discretion of the operator. The final feature on the pan input leads 16*b* is the "home" binary command. The "home" command resets the memory address counter 52 to all zeros. This feature enables the operator control 14** to return the sound to the original department speaker which in FIG. 3(*b*) is LF for channel CH1. All of the above pan features: direction, hold, and home, enable the operator control 14 to create a host of special sound pattern and positioning effects.

The memory address counter 52 outputs a data field 53 which comprises: the five least significant binary bits as address data field **53*a* and also as the midpan data field 53*c* and the two most significant bits as the quadrant data field 53*b*. The address data field 53a accesses a conventional read only memory 57, such as a Signetics 8223, and causes the read only memory 57 to output one of thirty-two digital amplitude values 58**.

Referring now to FIG. 2, the time scale TIME of chart 40 is divided into thirty-two equal time intervals T. These intervals correspond one-to-one for each memory address on address data leads **53*a*. At each time interval T, there exists two amplitude values: I for the volume of sound in the originating loudspeaker LF and D for the volume sound in termination loudspeaker RF. Such values are expressed in binary equivalents, one value for I and one value for D, and are stored in the read only memory 57** at each of the thirty-two memory address locations.

Referring again to FIG. 5, when the memory address counter 52 is incremented by timing pulses on lead 51, each increment represents the next time interval T and the next amplitude values of I and D to be outputted from the read only memory 57. Thus, the amplitude curves 43 and 45 are digitally reconstructed at the outputs 58 of the read only memory 57 as the sound pans from LF to RF. When the timing pulses on lead 51 decrement the memory address counter 52, the values of I and D are obtained on digital amplitude value leads 58, in the reverse manner, to effect panning from RF to LF. As mentioned, the rate at which memory address counter 52 is decremented or incremented is dependent on the value of voltage on pan speed input **16*a***.

The digital amplitude values on leads 58 enter a conventional digital-to-analog converter 59 such as an R-2R resistor network. The digital-to-analog converter 59 converts the binary values to corresponding analog amplitude values to be applied over leads 60. The amplitude values derived are similar to pan curve 40 relationships of I and D on the amplitude scale of FIG. 2 showing sixteen amplitude values. D/A converter 59 may actually be composed of two separate converters programmed to produce I and D from a common digital input 58.

Such analog amplitude values on leads 60 enter quadrant position logic 61 which is under digital control of the quadrant data field on leads **53*b*. The purpose of quadrant position logic 61 is to allocate the analog amplitude values of I and D on leads 60 for the appropriate pan quadrant shown in FIG. 2 as A, B, C or D. As time passes to listener 28** when the rotary pan effect has been selected, panning occurs as illustrated in FIG. 3(*a*) first from LF to RF in quadrant A, then from RF to RB in quadrant B, then from RB to LB in quadrant C, and, finally, panning occurs from LB to home position, LF, in quadrant D during time intervals T1–T4, respectively.

Figure 6:
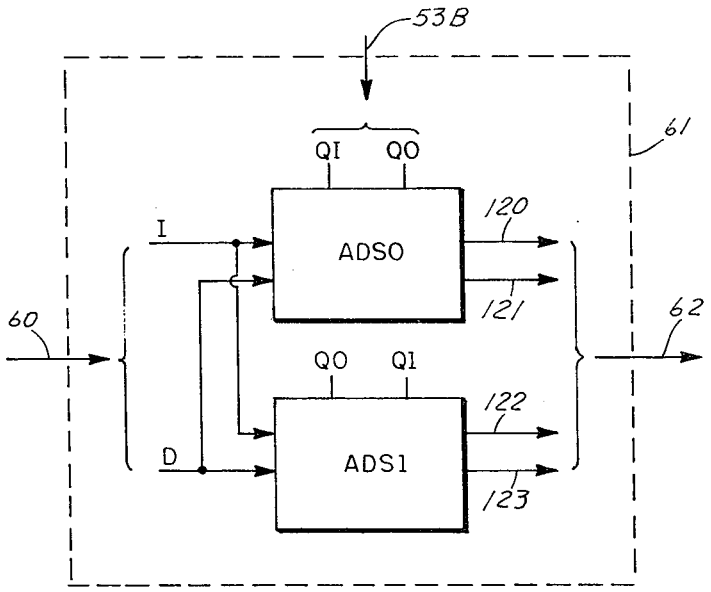
FIG. 6 shows detail of the quadrant position logic for use in FIG. 5 embodiment.

Referring now to FIG. 6, the preferred embodiment of the quadrant position logic 61 comprises two conventional analog data switches ADS0 and ADS1 manufactured by RCA (CO 4016A) or Motorola (MC 14016). The analog data switches ADS0 and ADS1 are under binary control on quadrant data field leads 53b which embrace the two most significant bits, Q1 and Q0, of the data field on leads 53. The binary truth table in FIG. 7(*a*) shows the Q1 and Q0 values which select the quadrants A, B, C or D.

Figure 7:
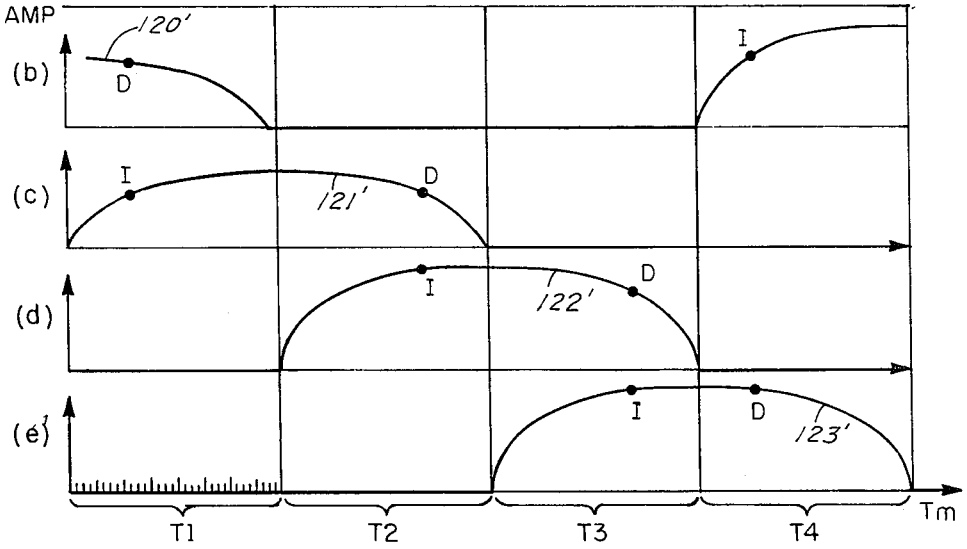
FIG. 7 illustrates the time based relationship of one sequence of quadrant selection panning.

FIGS. 6 and 7 are best explained in conjunction with each other and by way of illustration. When panning occurs in quadrant A, the quadrant position logic 61 sequentially receives thirty-two values of I and D on analog amplitude leads 60. Since panning is desired in quadrant A, both Q1 and Q0 are null thereby causing analog data switches ADS0 and ADS1 to sequentially place the thirty-two values of I and D onto leads 120 and 121 while maintaining outputs 122 and 123 null. The amplitude states of the four outputs 120-123 are shown in FIGS. 7*b*)–(*e*) as four separate graphs of time Tm versus amplitude Amp. Time Tm is segmented into four major parts, T1-T4, each part corresponding to the time required to pan quadrant, A, B, C and D, and each major part comprising thirty-two time intervals T as shown in chart 40 of FIG. 2. The amplitude curves 120', 121', 122' and 123' illustrate the output values on leads 120, 121, 122 and 123.

As mentioned, the memory address counter 52 is seven bits wide thus having a binary capacity for 128 decimal equivalents. The graphs in FIG. 7 each have 128 time positions. Thus, as the memory address counter 52, initially set at a zero position, begins counting up to decimal 32 only the least significant five bits are activated and panning for the rotary pan occurs in Quadrant A. On the thirty-second timing pulse on input 51, the least significant five bits are null and Q0 which is the sixth bit of data field 53 is set to one. When Q0 is "1" and Q1 is "0", the quadrant position logic 61 switches the value of I onto output lead 122 and switches the value of D onto output lead 121. In this manner, with the thirty-third timing pulse on input lead 51, panning for the rotary pan effect begins to occur in Quadrant B from speaker RF to speaker RB. Similar operations occur for the next two sets of 32 counts from counter 52 to effect panning through Quadrants C and D. When this memory address counter 52 reaches the decimal value of 127, all seven bits of the data field are "1" including Q1 and Q0 and the next timing pulse on lead 51 sets all seven bits to the null state or home position for the rotary pan at LF.

Thus, the position of apparent source 26 is uniquely defined around the periphery of room 30 by the seven binary bits from the memory address counter 52, the least significant five bits on leads 53a determine one of thirty-two time intervals T and the two most significant bits Q1 and Q0 on leads 53b select the specific quadrant A, B, C or D.

The pattern sequencer 19 performs the function of causing the apparent sound source 26 to follow a predetermined pattern about room 30. The pattern sequencer 19 as shown in FIG. 5 comprises a pattern memory 75 for data storage of pattern path information, a diagonal sequencer 70 for effectuating the panning of sound along the diagonals LB-RF and LF-RB in room 30 of FIG. 2, a shift sequencer for effectuating a shift in panning along the diagonals at the midpoint 47 of the pan (for example: panning begins at speaker LB along the diagonal to speaker RF, but at the center of room 30, the panning shifts to diagonal LF-RB and finishes panning in speaker LF), and an analog pattern sequencer 74 for generating the pattern path information.

The output 62 of the quadrant position logic 61 comprising leads 120–123 enters the diagonal sequencer 70 contained within the pattern sequencer 19, as shown in FIG. 5. Diagonal sequencer 70 comprises conventional analog switches, such as CMOS 4016 (not shown) manufactured by RCA, Motorola, etc., which under binary command of the operator control 14 on diagonal input lead 16*c*′ enables panning to occur along the diagonals LB-RF and LF-RB as shown in FIG. 2.

Figure 8:
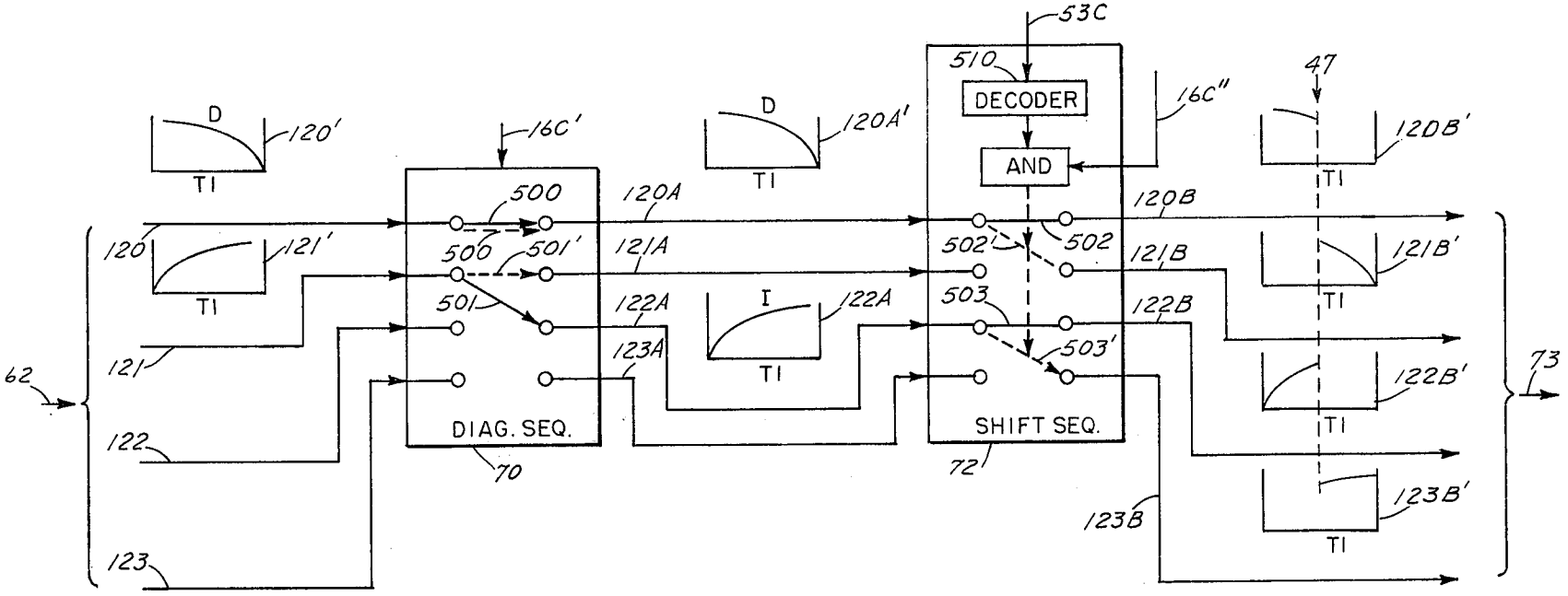
FIG. 8 provides additional detail of portions of the pattern sequencer for FIG. 5.

Referring now to FIG. 8, the diagonal sequencer 70 shows two analog switches, symbolically represented as 500 and 501. The input leads 120–123 in bundle 62 have analog amplitude values 120′ and 121′ during time interval T1, which corresponds to panning in Quadrant A for the rotary pan effect. When the diagonal sequencer 70 is activated by decoding binary control 16*c*′, the analog switches 500 and 501 in a conventional manner set up new paths for the analog amplitude values 120′ and 121′ to follow. The outputs 120*a* and 122*a* corresponding to a LB-RF pan carry analog amplitude values 120*a*′ and 122*a*′, respectively, as graphically shown. When the diagonal sequencer 70 is deactivated, there is no activation signal on lead 16*c*′ from the operator control 14 and the values of D on lead 120 and I on lead 121 pass through unaffected on connections 500′ and 501′ to leads 120*a* and 121*a*, respectively. In this mode, the diagonal sequencer 70 is transparent to the signals on leads 120–124. When the diagonal sequencer 70 is activated by an activation binary signal on lead 16*c*, then the rotary pan effect is altered into diagonal panning. Thus, during time interval T1, ignoring the shift sequencer 72, panning takes place along the diagonal LB-RF in room 30.

Referring back to FIG. 5, the diaigonal sequencer 70 interfaces with the shift sequencer 72 on leads 71. Shift sequencer 72 is controlled by binary signals on the midpan data leads 53*c* and the shift input lead 16*c*″ from operator control 14. As shown in FIG. 2, a midpan point 47 occurs when I and D are of equal magnitude at which time a corresponding unique memory address whose decimal value is 16 has been generated in the memory address counter 52. As shown in FIG. 8, the least significant five bits of data field 53 are delivered on leads 53*c* to a conventional binary decoder 510 (such as CMOS 4001 Quad 2-Input Nor Gate Decoding) residing in the shift sequencer 72. The decoder 510 emits a binary signal when the decimal 16 value exists on leads 53c.

With the concurrence of binary signals from the midpan decoder 510 and a shift command on lead 16*c*″ from operator control 14, the shift sequencer 72 creates such unusual sound effects as the star pan effect in FIG. 3(*g*). In the star pattern, during the first interval T1, the apparent sound source 26 appears to listener 28 to move towards the center of the room 30 along the LB-RF diagonal, suddenly veer, and finish panning along the LF-RB diagonal. Referring now to FIG. 8, the star effect is accomplished by activating the diagonal sequencer 70 in the following manner: The leads 120*a* and 122*a* carry analog vlaues D on chart 120*a*′ and I on chart 122*a*′, respectively, during time interval T1. These values are transmitted through the shift sequencer 72 unchanged and appear on outputs 120*b* and 122*b* until a midpan condition arises from midpan decoder 510. At the midpan point 47, the midpan decoder 510 emits a binary signal which causes the analog switches 502 and 503 to switch the data paths to 502′ and 503′ shown as dotted lines. This transfers the remaining pan amplitude values 120*a*′ and 122*a*′ to leads 121*b* and 123*b*, respectively. Prior to the mid-pan condition 47 the outputs 120*b* and 122*b* carrying the amplitude values 120*b*′ and 122*b* ′ effect panning along the LB-RF diagonal; and when midpan 47 is sensed by decoder 510 panning shifts to the LF-RB diagonal as determined by the amplitudes 121*b*′ and 123*b*′ on leads 121*b* and leads 123*b*, respectively.

Referring to FIG. 5, when the diagonal sequencer 70 and the shift sequencer 72 are not activated, they are transparent to the outputs 62 from quadrant position logic 61. In that mode, the outputs 62 are the same as the inputs 73 to the analog patter sequencer 74.

Referring back to FIG. 3(*a*), and the previous discussion of the rotary pan effect, special emphasis centered on sound originating in "home" speaker LB which panned to speaker RB in time interval T1. Of course, in a four-channel audio source, a plurality of different sounds can emanate from each channel. The primary function of the analog pattern sequencer 74 of FIG. 5 is to assign the analog amplitude values on leads 73 representing the basic two-pan effect of chart 40 to all channels in a predetermined pattern such that the four distinct sounds on each channel CH1-4 from the audio source 10 will pan between the proper speakers LF, RF, RB and LB to effect the pattern. The pattern is selected by toggle switch, not shown, or similar conventional selection device on the operator control 14 which generates a signal on one of the pattern input leads 16*c*‴. The pattern signal on lead 16*c*‴ addresses pattern memory 75, a conventional binary memory, such as a diode matrix, a read only memory, a read/-write memory, a manual switch set storage or the like. The output of pattern memory 75 on leads 76 control the analog pattern sequencer 74.

Figure 9:
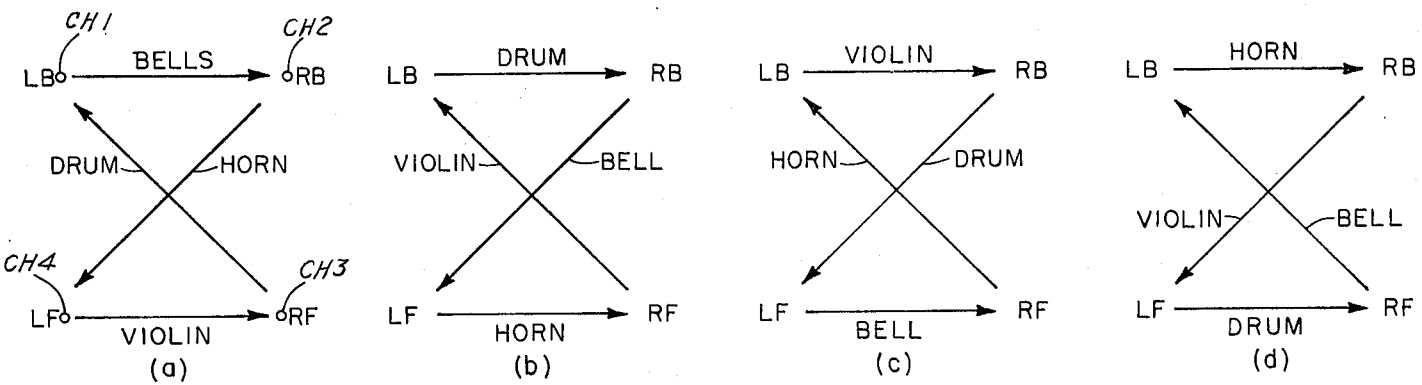
FIG. 9 illustrates one example of the various time intervals involved in generation of a figure-eight pattern.

Before discussing the analog pattern sequencer 74, an illustrative example would serve to clarify the effect occurring. Assume the following "home" conditions: a bell sound from LB, a horn sound from RB, a drum sound from RF, and a voilin sound from LF. Assume further the figure-eight pattern of FIG. 3(*f*) is selected. During time interval T1, as shown in FIG. 9(*a*), bells would pan to RB, horns would pan to LF, drums would pan to LB, and violins would pan to RF. During time interval T2, shown in FIG. 9(*b*), bells would pan to LF, horns would pan to RF, violins would pan to LB, and drums would pan to RB. During time interval T3, shown in FIG. 9(*c*), violins would pan to RB, drums to LF, bells to RF, and horns to LB. Finally, during time interval T4, shown in FIG. 9(*d*), all the sounds pan into their respective "home" channels.

Figure 10:
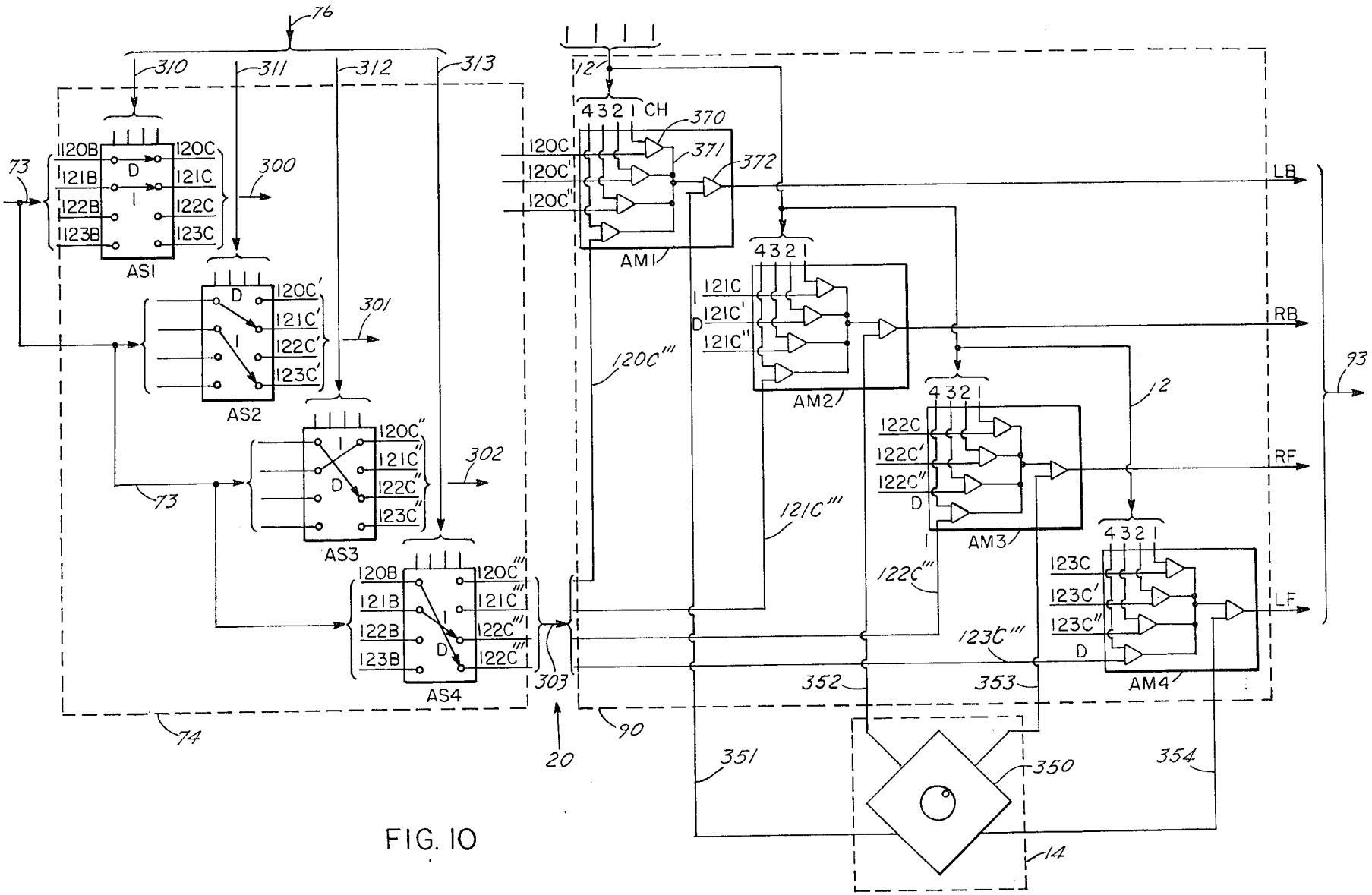
FIG. 10 shows detail of the analog pattern sequencer and analog mixer for FIG. 5.

Referring now to FIG. 10, the analog pattern sequencer 74 comprises four groupings of conventional analog data switches AS1-AS4, such as CMOS 4016 (RCA CO4016A or MOT MC 14016). Each grouping contains analog data switches, not shown, whose function is the set up of various paths between the inputs designated 120*b* –123*b* and the outputs generally designated 120*c* –123*c*. In each grouping each input can be connected to each output by means of the analog data switches. The inputs 120*b* –123*b* arrive from the shift sequencer 72 on bundle 73 and these inputs 120*b* –123*b* access each analog switch grouping AS1-AS4. The outputs, generally designated 120*c* –123*c*, of each analog data switch grouping AS1-AS4 are interconnected with the analog mixer 90 in the manner shown and to be later discussed. The path to be set up by each analog data switch grouping AS1-AS4 is determined by the binary control signals on branches 310–313 from the pattern memory 75 on bundle 76.

Analog switch grouping AS4 is typical of the other groupings AS1-AS3. The analog switches, not shown, are arranged such that any input 120*b* –123*b* can connect to any output 120*c*'''–123*c*'''. Analog switch bank AS4 symbolically shows 120*b* connected to 123*c*''' and 121*b* connected to 122*c*'''. Thus, analog switch grouping AS4 receives the two-pan amplitude data 73 on leads 120*b*–123*b*: D on input 120*b* and I on input 121*b*, and switches the amplitude value D to output 123*c*''' and amplitude valve I to output 122*c*'''.

By way of illustration, the aforementioned figure-eight pan pattern requires the paths as symbolically set up in analog switch groupings AS1-AS4 for time intervals T1 as shown in FIG. 10. During time interval T1, the values of I and D appear on leads 121*b* and 120*b*, respectively. During time interval T2, the values D and I would appear, respectively, on 121*b* and 122*b*, as shown in the graphs of FIG. 7. During all four time intervals T1–T4, the pattern interconnections of the analog data switches for groupings AS1-AS4 remain constant unless a pattern other than the figure-eight sound effect is selected on the operator control 14.

As will be further disclosed, the output bundles 300 through 303 of the analog groupings AS1 through AS4 effect the following pans during time interval T1 of FIG. 9 for the figure-eight pattern of FIG. 3(*e*). Output 300 with I on lead 121c and D on lead 120c effects an LB-RB pan; output 301 effects a RB-LF pan; output 302 effects an RF-LB pan; and output 303 effects an LF-RF pan.

Referring to FIG. 5, the analog switch 21 performs the function of coupling the audio inputs 12 to the speaker outputs 22 in a manner to effectuate the chosen pattern and effect. The analog switch in this embodiment comprises only an analog mixer 90 which performs the actual switching functions as follows.

The pattern select output leads 20 from the analog pattern sequencer 74 access the analog mixer 90 of the analog switch 21. The analog mixer 90 also receives audio inputs 12 carrying signals from the four channel audio source 10. The purpose of the analog mixer 90 is to mix the four channel audio inputs CH1-CH4 into a desired pattern of pan effects determined by operator control 14 and to deliver the mix to the speakers LB, RB, RF and LF.

The analog mixer 90 detailed in FIG. 10 comprises four analog mixer banks AM1-AM4. Each analog mixer bank contains five conventional analog amplifiers such as 370 and 372 which, for example, could be those manufactured by National (LM 3900). The input bundles 300–303 from the analog pattern sequencer 74 are interconnected to the analog mixer 90 as shown. For example, analog switch grouping AS4 accesses each of the analog mixers AM1-AM4 in the following manner: lead 120*c*''' access analog mixer AM1, lead 121*c*''' accesses analog mixer AM2, lead 122*c*''' accesses analog mixer AM3, and lead 123*c*''' accesses analog mixer AM4. Analog switch groupings AS1 through AS3 are interconnected with analog mixers AM1-AM4 in a similar manner. The four channels CH1-CH4 on input bundle 12 from audio source 10 commonly access each analog mixer AM1-AM4. The outputs from analog mixers AM1-AM4 access speakers LB, RB, RF and LF. Thus, the output from analog mixer AM1 carries the sound "mix" of channels CH1-CH4 to be heard by listener 28 of room 30 in speaker LB as illustrated in FIG. 10.

Analog mixer AM1 is representative of the other mixers. Each of the four analog amplifiers (370) in analog mixer AM1 has two inputs. One input (for example, lead 120c) arrives from the analog pattern sequencer 74 and one input arrives from the audio source 10 (for example, channel CH1). Whether or not the audio signal on channel CH1 is amplified by analog amplifier 370 depends on the analog amplitude value on the input 120C from the analog pattern sequencer 74.

The higher the amplitude value on input 120C, the greater the amplification of channel CH1. Thus, in analog mixer AM1, two inputs have amplitude values: Lead 120*c* as shown has an analog amplitude value of D and lead 120'' has an analog amplitude of I. Leads 120c' and 120c''' are at null level and hence their respective amplifiers 370 do not amplify or transmit signals on channels CH2 and CH4, respectively. Channel CH1 is amplified at a decreasing rate D and channel CH3 is amplified at an increasing rate I. The two amplified signals are mixed at the common junction 371. Thus, during time interval T1, the amplitude of the channel CH1 signal decreases from maximum value to zero as shown on amplitude curve 43, while the amplitude on channel CH3 signal increases from zero to maximum as shown in amplitude curve 45. The remaining analog mixers AM2-AM4 show the mixing of sound necessary to effect the figure-eight pattern of sound during time interval T1. Each analog mixer eventually accesses one speaker in room 30, and each analog mixer AM1-AM4 can mix the sound from any of the four input channels CH1-CH4. One skilled in the art readily observes that by adding more analog amplifiers at node 371, more input channels from audio source 10 can be mixed. Such flexibility enables the addition of more channels of sound to the patterns shown in FIG. 3.

The mixed sound at junction 371 enters the fifth analog amplifier 372 in analog mixer AM1. The purpose of analog amplifier 372 is to permit manual control of the amplitude of the mixed sound before delivery to a speaker 25 in order to create additional sound effects. In FIG. 1, the apparent sound source 26 travels from LB to the center of room 30 and then suddenly veers towards LF. This feature enables the listener 28 who may also be the operator of operator control 14 to cause the sound traveling from speaker LB to start out quiet and hushed and to grow to a crashing roar as it culminates in speaker LF. To this end, operator control 14 may include a conventional joystick 350 which, depending on its two-dimensional position delivers varying voltage amplitudes to the analog mixers AM1-AM4 on leads 351–354. When the joystick 350 is centered, the voltage amplitudes delivered on 351–354 are maximum and equal and the analog amplifier 372 operates at maximum amplification. In this position, the manual override of volume provided by joystick control 350 is transparent to the mixed sound on junctions 371 of analog mixers AM1–AM4.

The first alternate embodiment has been predominantly described based on the two-speaker pan effect as shown in FIG. 2. The digital position control 17 essentially generates the analog amplitude values as shown on chart 40 for the decreasing D and increasing I values between the two speakers in successive quadrants. The pattern sequencer 19 as described receives the analog two-speaker pan data and sequences the analog pan data in a predetermined pattern effectuating a plurality of pans between a given set of speakers for a plurality of channels. The analog switch 21 couples the audio inputs 12 to the speakers 25 in a manner responsive to the analog pattern data.

Figure 4:
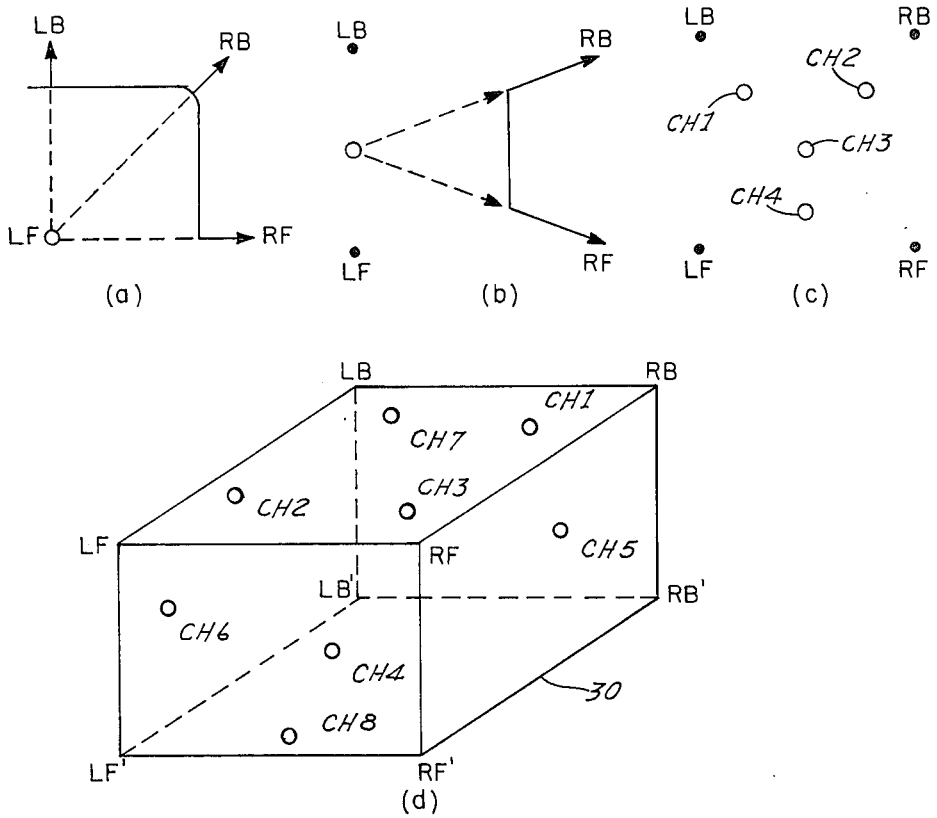
FIG. 4 shows additional panning sequences which can especially be realized through the use of this invention.
Figure 11:
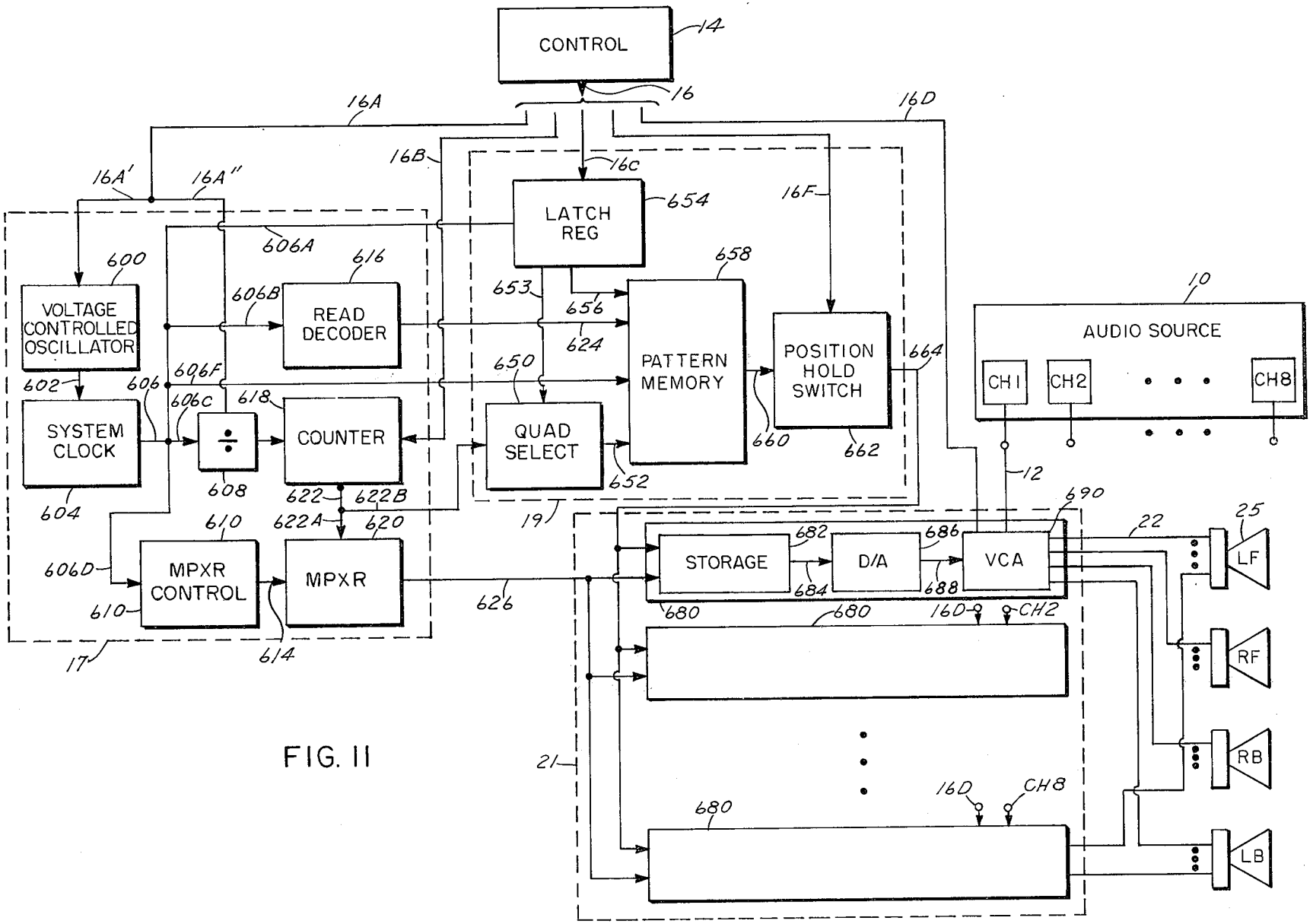
FIG. 11 is a block diagram of the elements involved in a second embodiment of the present invention.

An alternate embodiment of this invention is shown in FIG. 11, the common reference numerals of FIGS. 1 and 5 being retained for like parts or components and new reference numerals applied to dissimilar components or features. Control 14 communicates over common output line 16 with the digital position control 17, the pattern sequencer 19 and the analog switch 21. As before, the analog switch 21 couples the audio source 10 with the loudspeakers 25 to create the unusual sound effects of FIGS. 3 and 4 in the speakers LF, RF, RB and LB. Unlike the first alternate embodiment where the two-speaker analog pan data is generated in the digital position control 17, the second embodiment generates analog values in the analog switch 21 and, as will become clear, is not dependent on the two-speaker pan data. In this regard, this embodiment may effectuate panning from one speaker to three speakers as shown in FIG. 4(*a*). The most distinctive feature of this embodiment is the extensive use of digital processing in a multiplexed and time shared mode. FIG. 11 shows the functional interaction of the various components and will be discussed together with FIG. 12 which shows the basic data paths and timing relationships occurring in the multiplexed and time shared modes.

In this embodiment, it is again assumed that control 14 is arranged to permit maintenance of manual operator control over the audio pan generator 11. However, the digital position control in addition to timing, speed, and direction control outputs a stream of digital pan values corresponding to an increasing value I or a decreasing value D as found on chart 40 or a maximum or minimum digital amplitude value. The pattern sequencer 19 contains a plurality of predetermined pattern commands which selectively gates into the analog switch 21 the appropriate ditigal amplitude value from the output stream. The analog switch 21 converts the digital amplitude value into analog values and allocates the analog pan pattern among the appropriate speakers.

In addition, the digital position control 17 contains a voltage controlled oscillator 600, a system clock 604 and a divider 608 for generation of timing pulses, a multiplex control 610 and multiplexer 620 for generation of digital amplitude values, a read decoder 616 for generating a read signal for the pattern memory 658, and a counter 618 as a multiplex control. Each of these components will be analyzed in detail.

The pan speed input leads 16*a* contain a fine speed adjustment signal on branch 16*a*′, and a coarse speed control signal on branch 16*a*″. The fine speed control signal on lead 16*a*′ is generated by a variable voltage source within operator control 14 and accesses a voltage controlled oscillator 600 such as the model CMOS 4046 manufactured by RCA or Motorola Corporation which outputs a variable frequency train of pulses on lead 602. That is, the pulse frequency on 602 corresponds to the voltage level on lead 16*a*′. The variable frequency pulses on lead 602 enter a system clock 604 such as the CMOS 4040 and each incoming pulse on lead 602 advances by "1" the system clock 604 which is basically a binary counter. The variation of voltage on branch 16*a*′ enables the system clock to increase or decrease the rate at which the count accumulates within system clock 604 whose data field output appears on lead 606 and is fed through branches 606*a*-606F to the remaining system elements.

Figure 12:
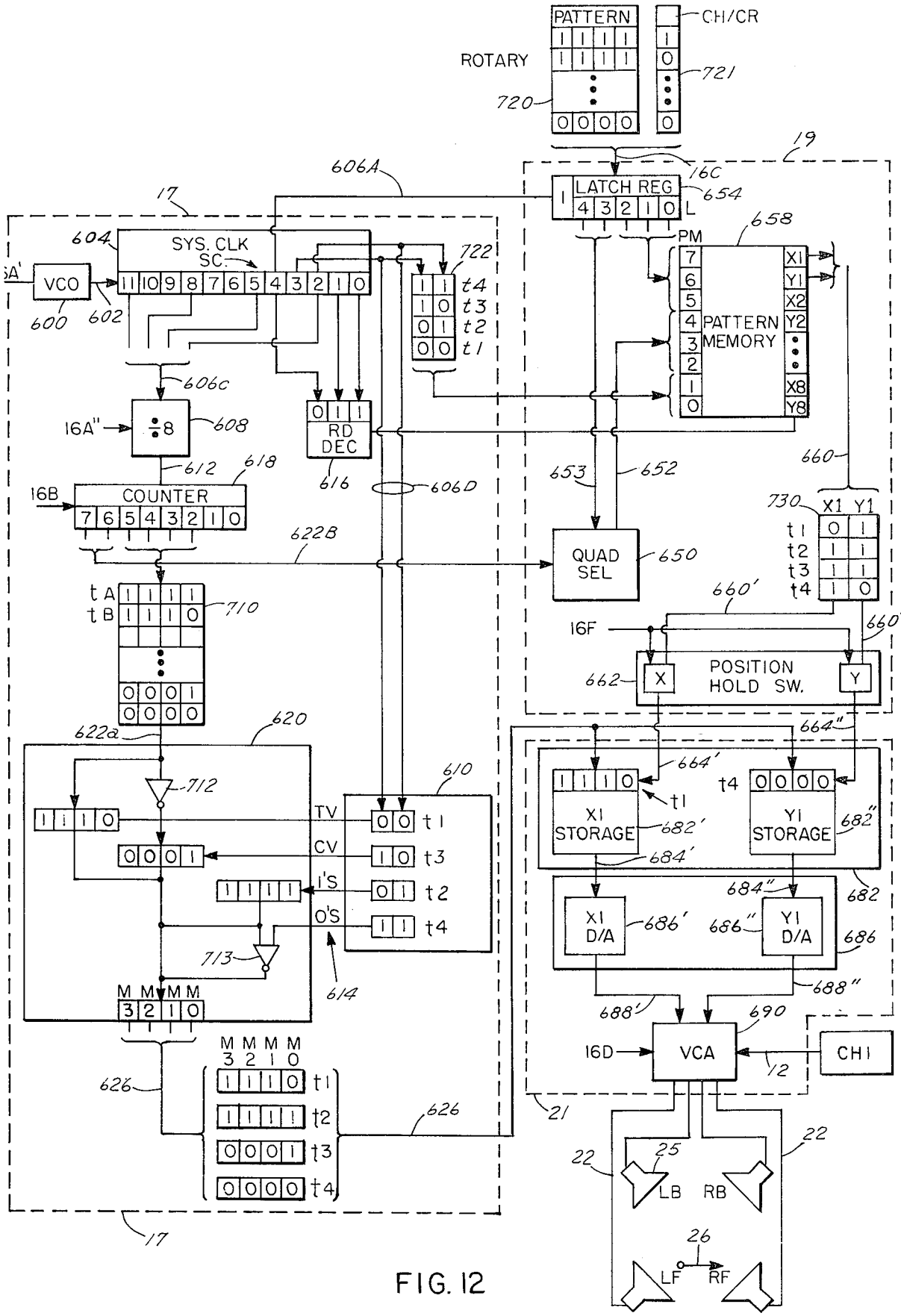
FIG. 12 shows the FIG. 11 circuitry and the data flow in greater detail.

The data field output 606 of the system clock 604 is shown in FIG. 12 to include 12 binary output bits SC0-SC11. A brief summary follows concerning the interaction of output bits SC0-SC11 with the system. The values SC3 and SC2 appear on both branches 606d accessing the multiplex control 610 and branches 606f accessing the pattern memory 658. The bits SC0, SC1 and SC4 are decoded by read decoder 616 for the particular state of SC4=0, SC1=1 and SC0 1 in which state the read decoder 616 emits a read command pulse on lead 624 for causing the pattern memory 658 to be read. When the bit SC4=1 is delivered by the branch 606*a* to the latch register 654, the latch register 654 loads the pattern code selected in the operator control 14 as represented by data block 720. The bits SC11, SC8, SC5 and SC2 are collectively grouped on branches 606C which enter a divide-by-eight circuit 608 wherein the coarse speed control signal on lead 16*a*″ selectively chooses one of the SC11, SC8, SC5 or SC2 signals for transmission of that signal to the counter 618 on lead 612. The counter 618 increases or decreases its count at a rate dependent upon the frequency of pulses entering on lead 612. For example, if the divide-by-eight logic 608 selects the pulses on SC2 then whenever the system clock 604 counts up to SC2=0, SC1=1 and SC0=1 the next increment will cause the SC2 bit to become SC2=1 and to increment counter 618 by "1". If the divide-by-eight logic 608 enables the SC5 lead, however, to drive the counter 618 then the counter 618 is incremented at a rate eight times slower than the above case where SC2 provided the driving pulses. Thus, operator control 14 provides a fine speed control branch 16*a*′ into VCO 600 and a coarse speed control on branch 16*a*″. As will be discussed later, the speed control, as in the first embodiment, governs the speed at which the apparent sound source 26 travels to observer 28.

As shown in FIG. 11, the multiplex control 610 reacts to the data SC3 and SC2 on branch 606d by sending commands to the multiplexer 620 on leads 614. The multiplexer 620 also receives digital signals on branch 622a. The function of the multiplex control 610 is to allow the multiplexer 620 to transmit to leads 626 the following digital values:

1. The true value "TV" of the data on branch 622*a*.
2. The complement value "CV" of the true value TV of the data on branch 622*a*.
3. To ignore the values on branch 622*a* and to generate all "ls" on lead 626.
4. To ignore the values on branch 622*a* and to generate all "Os" on lead 626.

The functional arrangement of FIG. 12 elaborates on this interaction. The multiplex control 610 receives inputs SC3 and SC2 from the system clock 604, these two binary inputs form four discrete decodable states wherein true value TV corresponds to the "00" state, complementary value CV corresponds to the "10" state, all ones correspond to the "01" value and all zeroes correspond to the "11" value for SC3 and SC2, respectively. The multiplex control 610 decodes the values appearing on SC3 and SC2 in a conventional manner to create command signals TV, CV, "ls" and "0s" whereby these signals control multiplexer 620.

The multiplexer 620 comprises conventional circuitry such as CMOS 4019 Quad AND-OR Select wherein the TV command from multiplex control 610 causes the multiplexer 620 to transmit a true value from the data block 710 appearing on leads 622a created as the counter 618 increases its count. The nature and function of the data 710 will be fully explained later. The complementary value command CV causes the multiplexer 620 to transmit the complement of a true value from the data 710 (as through the addition of an inverter 712). The "1s" and the "0s" commands cause the multiplexer 620 to output corresponding values of all "1s" or all "0s", the latter via inverter 713, independent of the data 710.

It is readily apparent that as SC3 and SC2 are advanced from their "00" to "11" values respectively corresponding to discrete time intervals *t*1–*t*4, the values M3-M0 appearing on bus 626 varies as shown in FIG. 12. For example, when SC3=1 and SC2=0 as at time T3 the multiplex control 610 generates a complementary value CV command causing the multiplexer 620 to complement the data appearing on lead 622*a* which at *t*A is C5=1, C4-1, C3-1, C2=0 and to deliver the complementary value CV onto the output bus 626 at T3 as M3=0, M2=0, M1=0 and M0=1. It is important to note that the counter 618 which generates the data block 710 operates at a much slower rate than the multiplex control 610 thus enabling the multiplex control 610 driven by bits SC3 and SC2 of the system clock 604 to sequentially load onto the bus 626 the values of M3-M0 for T1 through T4 before the input data 710 to the multiplexer 620 increments to the next value. Thus, the time interval tA has as a minimum four sub-time intervals *t*1–*t*4.

As shown in FIG. 11, the data M3-M0 appearing on bus 626 directly accesses the analog switch 21. It will become apparent that the data on bus 626 will be used to construct either the I or D panning curve as shown on chart 40 of FIG. 2.

In this embodiment the pattern sequencer 19 essentially provides gating commands on leads 664 for the analog switch 21 to selectively gate digital analog values on the common bus 626 from the digital position control 17. The pattern sequencer 19 performs this selective gating through interaction of a pattern memory 658 which contains the pattern path information for selective gating, the latch register 654 which stores the pattern code selected by operator control 14 for addressing the pattern memory 658, the quad select logic 650 for determining the quadrant of panning, and for each channel a position hold switch 662 which prevents the selective gating thereby "holding" the sound at a given position.

The determination of which pattern the sound 26 should follow occurs in the pattern sequencer 19. Latch register 654 composed of conventional circuitry such as, a CMOS 4042 Quad Clocked D-Latch stores the pattern code for one of many possible patterns as generated, for example, by conventional toggle switches within the control panel 14 and represented at pattern code block 720. The latch register 654 loads a given pattern code 720 and the chase/cross mode at code block 721 appearing on lead 16*c* from toggle switches, encoder or the like, not shown, on the operator control 14 for storage at periodic intervals when SC4=1 appears on branch 606a from the system clock 604. For example, if the rotary pattern code is "1111" and the chase pan code "0" is selected in the operator 14, then at count SC4=1 this information is gated in and stored as L4=1, L3=1, L2=1, L1=1 and L0=0. The output L2, L1 and L0 of latch register 654 directly accesses pattern memory address positions PM7, PM6 and PM5 of the pattern memory 658. The pattern memory 658 is a conventional read only memory such as 1602A PROM made by Intel.

The L4 and L3 values of the latch register 654 enter the Quad Select logic 650 comprising conventional logic such as CMOS 4019 Quad AND-OR Select. These two bits L4 and L3 are sufficient to define the four quadrants A, B, C and D. Bits C7 and C6 of the counter 618 represent the particular quadrant the pattern is panning. Bits C7 and C6 also access the Quad Select 650 on leads 622*b*. The values at SC3 and SC2 from system clock 604 directly address the pattern memory 658 at PM1 and PM0, respectively. Thus, in normal operation the relationship among the system clock 604 and read decoder 616, the latch register 654 and the quad select 650 with the pattern memory 658 is as follows since timing among the various entities is crucial. The quad select data appearing on leads 652 for PM4, PM3 and PM2 changes most infrequently since the quad select 650 is activated by bits C7 and C6 of the counter 618. Bits PM7, PM6 and PM5 of the pattern memory 658 are updated whenever SC4 of the system clock 604 becomes "1" thereby activating the latch register 654 to allow entry of the address memory bits PM6 and PM5. The update by SC4, however, may not change the pattern values if the pattern input values 720 have not been changed by the operator at operator control 14. Finally, the address memory bits PM1 and PM0 change frequently since they are derived from bits SC3 and SC2 of the system clock 604. For example, when SC3 and SC2 enter the T2 state SC3=0, SC2=1, SC1=0 and SC0=0, the time it takes for the SC1 and SC0 to count up to the "11" state provides ample time for the SC3=0 and SC2=1 state to address the pattern memory 658 and to allow for appropriate settling times in the pattern memory. Thus, when SC1 and SC0 reach the "11" state and SC4=0 the read decoder 616 emits a signal on lead 624 which enables the pattern memory 658 to output trigger values X1Y1-X8Y8 onto bus 660. In actual operation the *t*1–*t*4 values of SC3 and SC2 shown in data block 722 generate four unique addresses for the pattern memory 658 thereby outputting four different pattern trigger values appearing on bus 660 wherein FIG. 12 shows the four exemplary values of X1 and Y1 in data block 730. These four values appear sequentially in time on the trigger data bus 660 as *t*1–*t*4.

The position hold switch 662 comprises conventional logic as for example found in the CMOS 4011 Quad 2 input NAND Gate wherein the X1 value and the Y1 value normally are transmitted through the position hold switch 662 onto leads 664' and 664'', respectively, in order to access the analog switch 21. However, position hold switch 662 is under operator control on lead 16F which inhibits passage of the X1 and Y1 values when 16F is appropriately enabled. It is understood that there exists corresponding circuitry for the X2Y2 and so forth up to but not limited to X8Y8 which as will become apparent correspond to CH1-CH8.

In the present embodiment, the analog switch 21 of FIG. 12 couples the audio inputs 12 to the output speaker leads 22 through use of identical analog mixing configurations 680 for each channel. Each analog mixer 680 comprises a storage element for storage of the selectively gated two digital amplitude values from the common bus 626, two digital-to-analog converters 686 for conversion of the two digital values to analog values, and a voltage controlled amplifier 690 for controlling the panning effect among the output speakers 25 for a given channel.

The respective trigger inputs X1 and Y1 appearing on branches 664' and 664'' selectively gate in data appearing on the common bus 626 to their respective X1 storage 682' and Y1 storage 682''. For example, at time t1, the value appearing on the bus 626 is M3=1, M2=1, M1=1 and M0=0. At time *t*1, X1=0 and Y1=1. Note that although the ROM 658 (trigger) data 660 are read 0=active, the data are inverted through the read gating resulting in 1=active for the X and Y triggers. A "1" signal on either trigger input X1 or Y1 enables the data on 626 to be stored in the respective storage 682' or 682''. Thus, at time *t*1 the X1 storage 682' receives the binary value of "1110" equivalent to a decimal value of "14" and at *t*1 the Y1 storage 682'' is not activated. At times *t*2 and *t*3 both values for X1 and Y1 are "1" and thus no values on bus 626 are gated into storage. At *t*4, however, Y1 goes to "0" and the value on bus 626 at *t*4, M3=0, M2=0 and M1=0 and M0=0 is gated into the Y1 storage 682''. At the end of the timing sequence t1–t4, the following values are stored: X1=decimal 14 and Y1=decimal 0. It is apparent that for the next sequence of t1–t4, i.e., the tB interval, the X1 storage will contain the decimal 15 and the Y1 storage will still contain the decimal 0. These decimal values appear on leads 682' and 684'', respectively, and access respective digital-to-analog converters 686' and 686''. In turn, the digital-to-analog converters transform the decimal values into analog values which appear on leads 688' and 688''. The digital-to-analog converters can be any of a variety of conventional types such as an R-2R resistor network. The analog X1 value on lead 688' and the analog Y1 value on the lead 688'' enter a conventional voltage controlled amplifier 690 such as the Allison VCA 2-5A. The voltage controlled amplifier 690 responds in the following manner to the X1 and Y1 analog signals. When X1 is varied from zero to maximum analog voltage and Y1 is held at 0 voltage panning occurs from LF to the RF speakers. When X is held at maximum analog voltage and Y is varied from zero to maximum value panning occurs from the RF speaker to the RB speaker. When Y1 is held at maximum analog voltage and X1 is decreased from a maximum to zero voltage panning occurs from RB to LB. When X1 is held at zero and Y1 decreases from a maximum value to zero panning occurs from LB to LF. Thus by merely controlling the values of voltage appearing on X1 and Y1 the rotary pan effect can easily be created.

Figure 13:
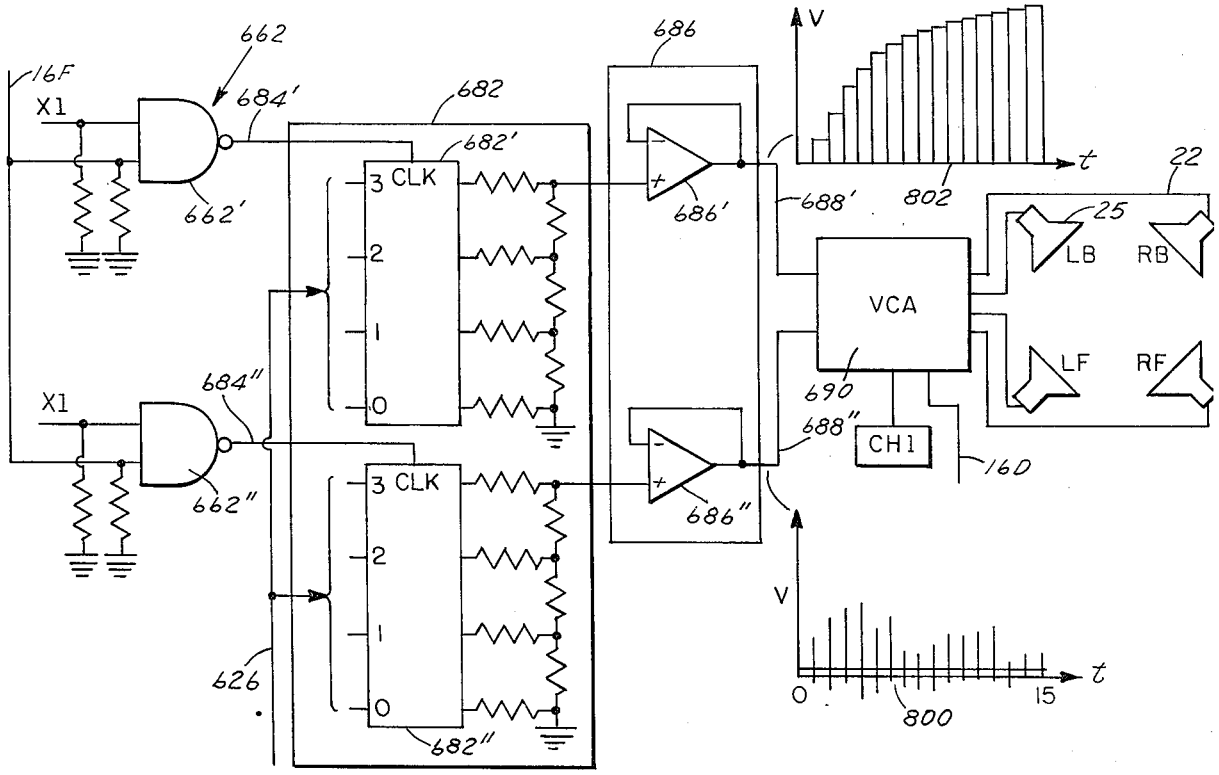
FIG. 13 illustrates the generation of two analog output levels using the circuitry of FIGS. 11 and 12.

FIG. 13 shows a detailed circuit schematic of the position hold switch 662, the storage 682 and the digital-to-analog converters 686. Of special significance are the charts 800 and 802 which show the voltage values appearing on leads 688'' and 688', respectively. Chart 802 illustrates that there are sixteen values of voltages in a step function relationship generated exclusively by the binary values shown in chart 910 of FIG. 14. As the values in chart 910 are generated from "0000" to "1111", corresponding analog values appear in lead 688. Chart 800 illustrates the holding of zero during the time interval.

Figure 14:
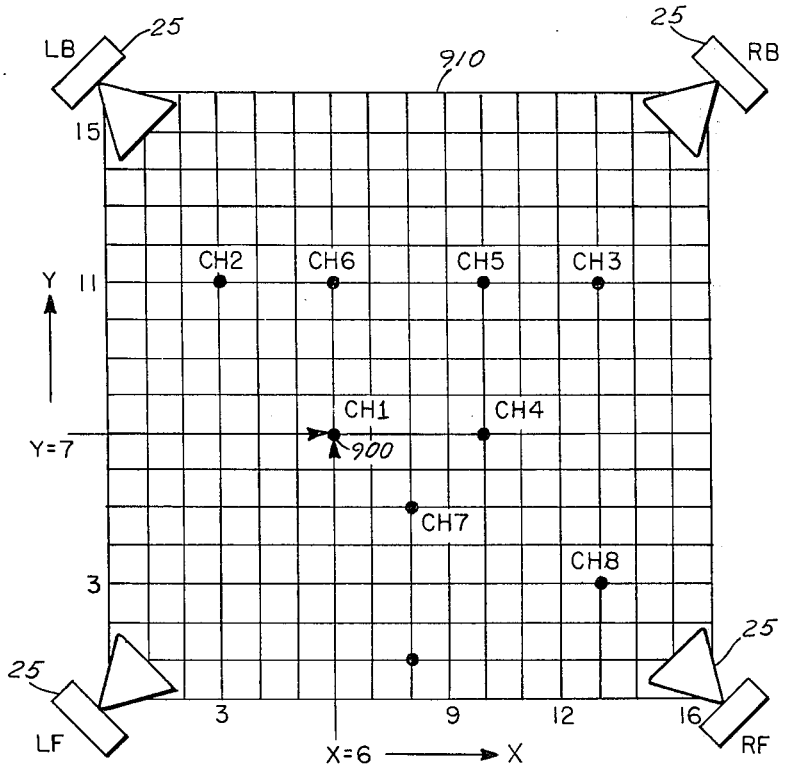
FIG. 14 illustrates the X–Y selection of various potential apparent sound sources available through the circuitry of FIGS. 11–13.

In addition, by varying both the voltages X1 and Y1 the panning can take place between all four speakers and sound may be positioned at any of one of 256 unique positions in the room. X1 and Y1 each have four binary bits the combination of the two can address 256 unique positions in the room. FIG. 14 shows a 256 grid network 910 positioned between the speakers 25. This figure shows the result of utilizing the position hold switch 662 wherein the operator has activated lead 16f prohibiting the updating of the storage 682. Since further updating is prohibited, the sound stops panning and becomes stationery. The pattern memory 658 is capable of handling a plurality of channels. For illustration purposes eight channels are shown in FIG. 12. Each of these eight channels have different X and Y analog values corresponding to a different decimal number between 0 and 15. In FIG. 14, channel 1 at position 900 has a decimal value of 7 for Y while X has a decimal value of 6. As long as the position hold switch 662 is activated the sound from channel 1 will appear to originate from position 900 of the grid 910. The remaining channels can also be allocated to different and unique positions as shown in FIG. 14. The major effect of this invention is to provide the means in which sound can be positioned anywhere within a room such as for simulating an actual orchestra.

FIG. 4 illustrates other effects that may be created by the second embodiment. FIG. 4(a) illustrates a moving wall of sound from speaker LF which can be created by causing X and Y to both increase from zero amplitude to maximum amplitude on leads 688' and 688'', respectiveley. The remaining patterns are extensions of the above discussions.

It should be recognized that the total power being produced from all four transducers in coupling the sound from any given input channel preferably is kept constant throughout any quad panning. This power distribution is handled automatically by the Allison VCA 2-5A mentioned for VCA 690 via a panning network which responds to the X-Y inputs to appropriately control the gain of four output amplifiers which are coupled to drive respective output transducers 25. The panning matrix converts the X-Y coordinate position values to gain control values for each amplifier coupled to the various output transducers. The X-Y values define the distance D from the transducer's position to each of the outputs according to the Pythagorean theorem. That is, the gain value for a given distance D is the cosine value for that percentage of pan. If the sound is to come entirely from a particular transducer, D=O and cos 0=1. For half the distance between two transducers, D=0.5 and cos 45=.707 while complete panning to the second transducer means D=1 and cos 90=0 (i.e., no sound pan from the pan originating transducer). As mentioned, the 256 potential apparent sound source positions are each definable by the data contained in an eight bit word, four bits each for X and Y. This can be correlated to gain Vc and power loss P as is illustrated in the following examples.

For the first example, assume four transducers 25 are oriented as shown in FIG. 14. Assume further that the input channel is to be coupled exclusively to transducer No. 1 or from the left front transducer. This corresponds to a data word of 0000 0000 which specifies that D1 (the distance from the apparent sound source to transducer No. 1) is zero so that Vc1=0 and P1=0db whereas D2–D4 are all equal to or greater than 1 so that Vc for each is 0 and no output power is produced. In the next example, assume that the apparent sound from one input channel is to come from the center front of the listening area halfway between transducer No. 1 and transducer No. 2. This corresponds to a data word of 1000 0000 which correlates to D1 and D2 both being 0.5 so that Vc1 and Vc2 are both 0.707 and P1 and P2 are both −3db. D3 and D4 are both greater than one so that Vc3 and Vc4 are zero. Transducers No. 1 and No. 2 are thus each producing half the power and No. 3 and No. 4 are producing none.

As a final example, assume the apparent sound is to come from the center of the listening area. This corresponds to a data word of 1000 1000 which correlates to D1–D4 all being 0.707, Vc1-Vc4 all being 0.5 and P1-P4 all being −6db. Thus transducers No. 1 through No. 4 are each producing one-fourth the total power.

From the basic relationships of the foregoing examples and the detailed description of the preferred embodiments, various modifications of the present invention become readily apparent. For instance, the panning network in VCA 690 could be replaced with a network for decoding the data word and producing appropriate operational amplifier gain signals. This could be done by addressing another memory to produce digital bytes into respective digital-to-analog converters which in turn control the gain settings of four output amplifiers having a given channel commonly coupled thereto. Further, the amplifiers could each have a buffer arrangement for storing its gain setting with these buffers being multiplexed for a plurality of input channels. The buffers could be digital with separate digital-to-analog converters for each input or a single capacitive sample and hold circuit could be included for each output amplifier if the multiplexer speed is fast enough. In each case, there would be a complete set of amplifiers for each input channel, these sets each having the same number of amplifiers as the number of output transducers.

Under some circumstances, it may even be desirable to include circuitry for computing appropriate gain settings as a function of the distances D defined by the X-Y data word. This might be arranged to directly load digital-to-analog converters or to select gain settings via a table look-up operation.

Although the present invention has been described in considerable detail particularly with respect to the preferred embodiments thereof, various changes, modifications and/or additions will be apparent to those having normal skill in the art without departing from the spirit of the invention. For instance, part or all of the signals provided by control 14 can be provided by the digital and analog input/output available from computers or automated control units. Yet another example is that the read only memories could be replaced with read/write memories which could further be loaded from external sources, an arrangement particularly useful for permitting dynamic changes to the stored patterns.

What is claimed is:

1. Apparatus for introducing audio signals from at least one source to a plurality of audio output transducers for creating sound patterns and effects relative to a listener comprising:
   - means for generating variable signal levels,
   - means for storing data corresponding to a switching pattern,
   - means for producing an output corresponding to the switching pattern from said storing means, and
   - output means responsive to said generating means and to the output of said producing means for coupling the audio signals from at least one audio source into at least two of the audio output transducers identified by the switching pattern with magnitudes corresponding to the variable signal level from said generating means.

2. Apparatus in accordance with claim 1 wherein:
   - said storing means contains data corresponding to a plurality of switching patterns, and
   - said producing means includes means for selecting one of the switching patterns from said storing means as the output of said producing means.

3. Apparatus in accordance with claim 1 which further includes means for controlling the rate of change of the variable signal levels from said generating means.

4. Apparatus in accordance with claim 1 which further includes means for selectably disabling said generating means so that the signal levels thereof remain fixed until deactivation of said disabling means whereby the apparent sound sources from said transducers will appear to cease movement.

5. Apparatus in accordance with claim 1 wherein
   - said generating means produces cycles of said variable signal levels and wherein
   - said output means is responsive to the switching pattern from said storing means and said generating means signal levels for coupling audio from at least one audio source to one pair of audio output transducers for a complete cycle of said generating means signal levels and for changing the transducer pair coupling in accordance with the switching pattern from said storing means for the next cycle of said generating means signal levels.

6. Apparatus in accordance with claim 1 for use wherein the plurality of audio output transducers are sufficient in number and placement for defining a plurality of sound source sectors and wherein said output means further includes:
   - means responsive to the switching pattern from said storing means for establishing potential connections of at least one audio signal source to a multiplicity of pairs of the audio output transducers, said apparatus further including
   - means for cycling said generating means signal levels through the multiplicity of transducer pair connections set by said establishing means whereby the sound can appear to travel through the sectors defined by the audio transducers.

7. Apparatus for introducing audio signals from at least one source to a plurality of audio output transducers for creating sound patterns and effects comprising:

a source of clock pulses, means responsiive to said clock pulses for generating cycles of pairs of increasing and decreasing signal levels, a plurality of voltage controlled amplifiers having the outputs thereof connected to respective transducers and each having one of the inputs thereof connected for receiving the audio signals from at least one audio signal source, means for switching the pairs of signal levels from said generating means to said plurality of amplifiers, and input means for providing control signals to said switching means for selectably establishing connection of the signal level pairs from said generating means to provide the respective other inputs to at least two of said amplifiers, whereby the sound from the source will appear to move relative to the audio transducers selected by the said input means control signals at a rate determined by the said generating means signal levels.

8. Apparatus in accordance with claim 7 which further includes means for controlling the rate that signals are produced by said source of clock pulses, whereby the apparent movement of sound between the transducers will occur at a rate of speed determined by said controlling means.

9. Apparatus in accordance with claim 8 wherein said signal level pair generating means includes counting means for cyclically counting the pulses from said clock pulse source, addressable storage means responsive to at least part of said counting means for producing pairs of digital output signals and digital-to-analog converting means responsive to said addressable storage means output signals for providing said generating means increasing and decreasing signal level pairs.

10. Apparatus in accordance with claim 9 for use with a plurality of transducers which are sufficient in number and placement for defining a plurality of apparent sound source sectors wherein said switching means has sufficient input connecting pairs thereto to correspond to the transducers defining each apparent sound sector, said signal level pair generating means further includes sector switching means for coupling said signal level pair to sequential sets of said sector switching means input connection pairs in response to the completion of each cycle of said increasing and decreasing signal levels.

11. Apparatus in accordance with claim 7 for use with a plurality of transducers of sufficient number and placement for defining a plurality of apparent sound source sectors wherein said signal level pair generating means is arranged for producing cycles of said signal level pairs on sequences of output leads, said switching means further including means for storing data reflecting a plurality of switch patterns and means for selecting one of said switch patterns, and means responsive to the selected switch pattern for establishing connection in accordance therewith between said generating means output lead pairs and pairs of said voltage controlled amplifiers.

12. Apparatus in accordance with claim 7 for use with a plurality of transducers of sufficient number and placement for defining a plurality of apparent sound source sectors and wherein said switching means is arranged for coupling said generating means signal pairs to said amplifiers when in a first state for causing the apparent sound to circumferentially travel around the sectors and when in a second state for causing the apparent sound to travel diagonally relative to said sectors, said apparatus further including means for selecting between said first and second states.

13. Apparatus in accordance with claim 12 wherein said switching means further includes:

shifting means coupled between said switching means output and said amplifiers for causing the apparent sound source to change from one diagonal to another when enabled, and means for selectably enabling said shifting means.

14. Apparatus in accordance with claim 13 wherein said switching means further includes:

storage means containing a plurality of addressable switching patterns, means for addressing said storage means for causing one of the addressable patterns to be produced as an output therefrom, and a switching network coupled between said shifting means output and the inputs for said amplifiers for causing the audio from the source to be connected to the output transducers in apparent sound pattern sequences determined by the pattern output of said storage means, the enabled state of said shifting means and the state of said switching means.

15. Apparatus for introducing audio signals from at least one source to a plurality of audio output transducers for creating sound patterns and effects comprising:

analog switch means for coupling audio signals from the source to the plurality of audio output transducers with magnitudes corresponding to digital values at the input of said analog switch means, digital position means for cyclically generating first and second fields of digital output signals wherein said first field provides sequentially changing data throughout each cycle while said second field provides fixed data values throughout each cycle, clock pulse means for providing cycles of clock pulses for actuating said digital position means, storage means for storing digital data at addressable locations wherein said digital data identifies the output transducers to be actuated by said analog switch means and an associated field of said digital position means output, register means for receiving signals specifying addressable locations of said storage means, and connecting means responsive to the digital data read from the location of said storage means addressed by said register means for connecting the said associated field selected thereby from said digital position means to the said analog switch means identified by the digital data read from the said addressed location, whereby said analog switch means sequentially energizes the transducers selected by said storage means output with magnitude corresponding to the said associated field from said digital position means.

16. Apparatus in accordance with claim 15 which further includes:

means for controlling the frequency of the pulses produced by said clock pulse means.

17. Apparatus in accordance with claim 16 wherein said clock pulse means includes:

a voltage controlled oscillator, and a multiple stage counter for counting the pulses from said oscillator, said controlling means including means for selecting the input voltage for said oscillator and means for selecting the stages of said counter to be used as the output thereof, said connecting means being responsive to said oscillator output for sequentially reading out a plurality of locations from said storage means, said digital position means being responsive to the selected said counter stages for sequentially updating said first and second fields.

18. Apparatus in accordance with claim 17 for use with audio output transducers of sufficient number and placement for defining a plurality of apparent sound sectors to a listener which apparatus further comprises:

sector selection means responsive to signals from said counter for providing a portion of the location addresses for said storage means in conjunction with said register means, said sector selection means being arranged to change value upon the completion of each cycle of said first and second fields of said digital position means.

19. Apparatus in accordance with claim 18 wherein said digital position means includes:

first means for producing an increasing first field and a decreasing first field, and second means for producing a maximum second field and a minimum second field, the addressed locations from said storage means further being arranged for actuating said analog switch means for each transducer with one of the fields from said first and second producing means.

20. Apparatus in accordance with claim 19 wherein said analog switch means includes:

means for retaining digital data, means responsive to said storage means output for placing the selected field from said producing means in said retaining means, means for converting said field from said retaining means into an analog equivalent, and analog amplifier means for coupling audio signals to output transducers with a magnitude controlled by said converting means output.

21. Apparatus in accordance with claim 20 which further includes:

position hold means interconnecting said storage means output and said retaining means and being actuable for blocking transfer of fields from said producing means to said retaining means, and input means for selectably actuating said position hold means.

22. Apparatus in accordance with claim 20 wherein there are at least four transducers arranged at the corners of quadrant sectors around the listener, said apparatus further including:

first and second portions of said retaining means, said converting means including first and second digital-to-analog converters coupled to be energized by said first and second retaining means portions, respectively, said analog amplifier means coupling the analog from said first converter to the transducers along one axis of the quadrant and the analog from said second converter along an axis of the quadrant perpendicular to the one axis.

23. Apparatus in accordance with claim 22 for use with a plurality of audio sources, said apparatus further including:

a plurality of said analog switch means, each arranged for coupling a respective audio source to the transducers of the quadrant, said storage means having at least one pair of outputs for each said analog switch means, and said connecting means being arranged for controlling the transfer of selected fields from said field producing means to the said plurality of analog switch means in accordance with said storage means output.

24. A method for transferring signals from at least one source as sound patterns and effects from a plurality of transducers arranged around a listening area comprising the steps of:

generating cycles of amplitude control signals, storing data reflecting the identity of the transducers that should be energized for each of a plurality of patterns and the control signals to be associated therewith, selecting one of the stored patterns, and connecting the audio signals from the source to the transducers identified by the selected pattern with magnitudes corresponding to the control signals associated therewith.

25. The method in accordance with claim 24 which includes the further steps of:

controlling the rate which the amplitude control signal cycles are generated so that the apparent speed of sound movement between transducers is controlled in accordance therewith.

26. The method in accordance with claim 25 which includes the further steps of:

providing a hold input signal, and responding to the hold input signal by retaining the amplitude control signal and the transducer identity as present when the hold signal occurred so that the apparent sound from the transducers appears to stop and continue to originate from one position.

27. The method in accordance with claim 24 for use with a plurality of signal sources wherein:

said storing step includes the storing of data for respective signal sources, said selecting step includes selection of the stored data for each source, and the connecting step includes the coupling of each source to at least two of the transducers as specified by the data stored for that source in magnitudes specified by the control signals associated therewith.

28. A method in accordance with claim 24 wherein said data storing step includes the storing of sequences of data corresponding to sequences of pairs of transducers, and said selecting step includes the steps of sequentially selecting the data stored at the completion of each amplitude control signal cycle.

* * * * *